US005474460A

United States Patent [19]

Tirrell et al.

[11] Patent Number: 5,474,460

[45] Date of Patent: Dec. 12, 1995

[54] POWER INTERCONNECT SYSTEM FOR ELECTRONIC ASSEMBLIES

[75] Inventors: Paul Tirrell, Uxbridge, Mass.; Larry Pignolet, Woonsocket, R.I.; Lee Spechts, Billerica, Mass.

[73] Assignee: EMC Corporation, Hopkinton, Mass.

[21] Appl. No.: 294,886

[22] Filed: Aug. 23, 1994

[51] Int. Cl.[6] ..... H01R 4/30

[52] U.S. Cl. ..... 439/121; 439/801

[58] Field of Search ..... 439/212, 110, 439/121, 122, 801, 207, 209, 211, 214, 216, 215, 543, 564, 573, 362, 365

[56] References Cited

U.S. PATENT DOCUMENTS

| | | | |
|---|---|---|---|
| 2,806,999 | 9/1957 | Pichitino | 439/801 |
| 3,380,014 | 4/1968 | Schenker et al. | 439/801 |
| 3,577,114 | 12/1971 | Hawkins | 439/801 |
| 4,354,725 | 10/1982 | Herbaugh et al. | 439/801 |
| 4,749,357 | 6/1988 | Foley | 439/65 |
| 5,298,681 | 3/1994 | Swift et al. | 174/48 |

*Primary Examiner*—Gary F. Paumen

*Attorney, Agent, or Firm*—Daniel J. Bourque; Kevin J. Carroll; David D. Lowry

[57] ABSTRACT

A power interconnect system for electronic assemblies, for providing electrical connections between a power supply and a remote electrical conductor element, such as a power bus bar. An electrically insulating block is connected to a bus bar, and holds captive a power coupling connector element for engaging and connecting the bus bar to a power supply. The power coupling connector element includes a conductive end and an insulative end to prevent the supply from shorting out or shocking a maintenance person in contact with the insulative end even when the system is powered up. The conductive end has a larger diameter than the insulative end and the entire power coupling connector element is held captive within the block of insulating material when mounted to a power bus bar, to prevent the power coupling connector element from becoming loose within an electronic assembly.

13 Claims, 2 Drawing Sheets

POWER INTERCONNECT SYSTEM FOR ELECTRONIC ASSEMBLIES

FIELD OF THE INVENTION

This invention relates to electronic assemblies, and more particularly to a power interconnect system for electronic systems.

BACKGROUND OF THE INVENTION

In almost all electronic assemblies, power for the various system components must be supplied throughout the system from a central power source. This is often accomplished by power supply bus bars which provide power to throughout the system, allowing individual components and sub-assemblies such as circuit boards, disk drives, etc., to individually connect to the bus bars to receive power. In many systems, power of different voltages are required by the different sub-assemblies. Thus, often more than two bus bars are necessary to supply power within a system. These electronic systems can vary in size from a small box to a large cabinet which can fill a room.

The power supply within such electronic systems are often high voltage and amperage supplies, requiring proper separation of conductive paths, proper shielding, and also good connections throughout the system. These connections must be secure both electrically and mechanically to prevent failure during the life of the system.

Bus bars are often electrically connected to power supplies using threaded connectors with standard nuts to connect the bus bar to the threaded connector on the power supply. This provides a tight mechanical and electrical connection. Lock washers can be used to prevent the connection from loosening up over time. Such nuts are usually made of a conductive material such as steel.

This arrangement, however, can cause problems in that since the nuts are electrically conductive, they can cause electrical shorts within a system if the become loose and fall off the threaded connector. If someone is tightening up a nut which connects to a live power supply, there is a risk that the person may receive an electrical shock if the voltage or amperage is high enough. Also, shorts to other parts of the system can easily happen when these nuts or other connecting materials are being tightened. Another problem occurs when such conductive nuts fall off of threaded studs before they can tightened and become lost within a system. If a nut falls down and shorts out some other components near the power supply, catastrophic results can occur. Retrieving lost nuts from inside a cabinet system is often difficult if not impossible, as well as time consuming.

Accordingly, what is needed is a power interconnect system for connecting power supplies or other components within a system to power bus bar connectors, which cannot cause shorts when being tightened or loosened, and cannot separate or become lost within a system, and which can be engaged with a "hot" or functioning power supply without danger of electrical shock.

SUMMARY OF THE INVENTION

This invention features a power interconnect system for electronic assemblies which allows connecting of power supplies or other components within a system to remote electrical conductor elements. An electrically insulative enclosure holds captive a power coupling connector element which interconnects a source of electric power to a remote electrical conductor element, such as a bus bar. The power coupling connector element includes a conductive end which connects the power supply to the remote electrical conductor element, and an exposed insulative end which prevents the shorting out of the power system through any tools or individuals tightening the connection should the system power be live. The power coupling connector element also has a larger conductive end which keeps the power conducting connector element captive within the electrically insulative enclosure, preventing it from becoming loose within the electronic assembly and possibly causing shorts or other problems within the electronic assembly.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
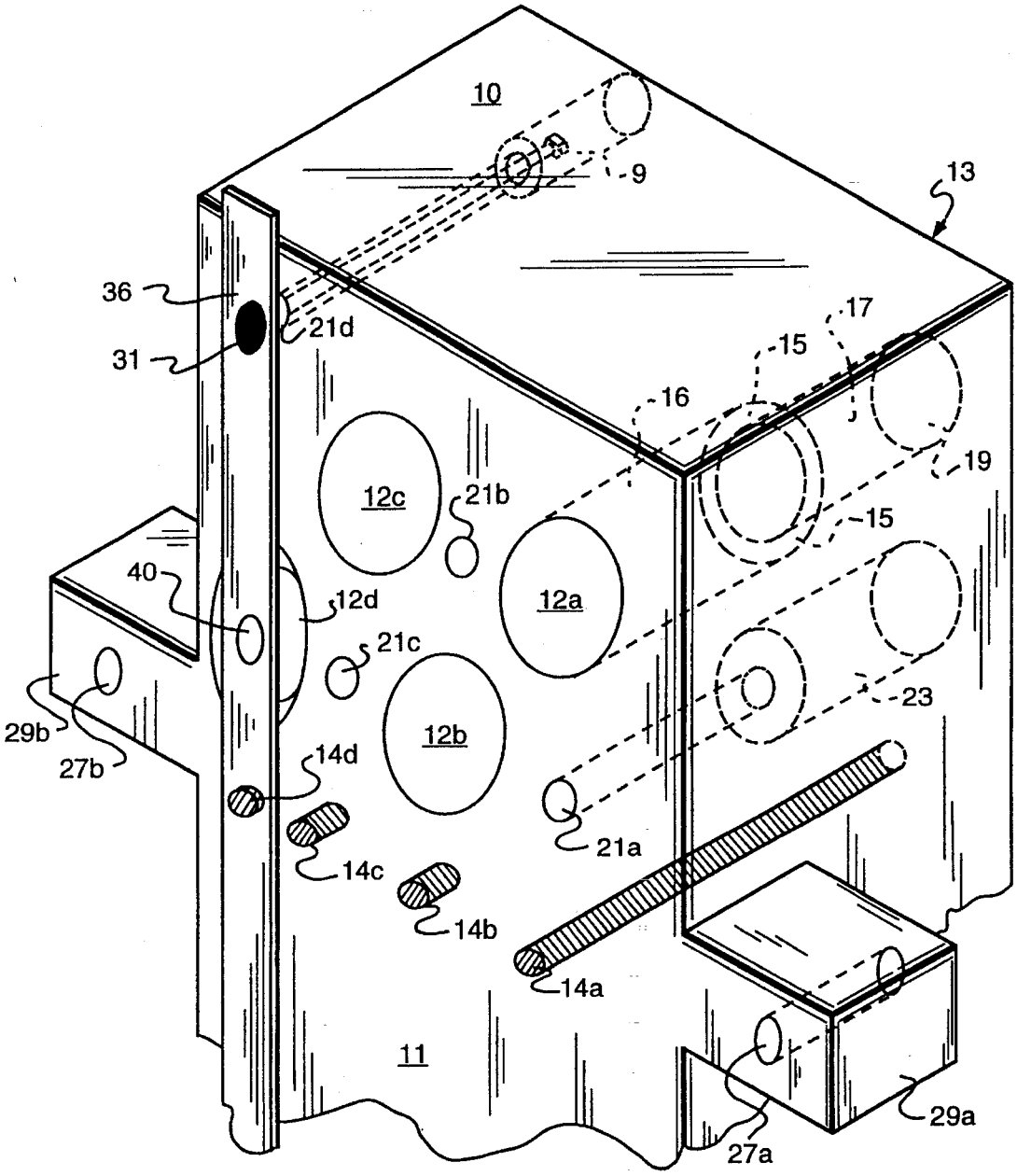
FIG. 1 is a partial schematic view of the electrically insulative enclosure of the power interconnect system of the present invention.

The power interconnect system of the present invention includes an electrically insulative member or block 10, FIG. 1, which holds and contains the power coupling connector elements (not shown), as will be further explained below. Block 10 comprises an electrically insulative material such as Lexan® or other polycarbonate material. Block 10 includes a plurality of holes 12*a*–12*d* on front surface 11, which extend at least partially through block 10. Each of holes 12*a*–12*d* extends part way through the block 10 to form a cylindrical cavity 16 of a first predetermined diameter of approximately two centimeters. Cylindrical cavity 16 extends part way through block 10 to proximate region 15 where it connects to a smaller cylindrical cavity 17 which extends through the back surface 13 of block 10 to form hole 19.

Smaller cylindrical cavity 17 has a predetermined diameter of approximately 1.5 centimeters. The transition between cylindrical cavities 16 and 17 forms a lip region 15 which surrounds the smaller opening to cylindrical cavity 17. Therefore, an object with a diameter larger than the diameter of cylindrical cavity 17 will not pass through the opening created by lip region 15 through block 10.

Block 10 also includes a plurality of holes 21*a*–21*d* (21*d* not visible), which extend from front surface 11 of block 10 at least partially through the insulative material of block 10. Each of holes 21*a*–21*d* extends through the material to form a cylindrical cavity of a predetermined diameter of approximately 0.7 centimeters. Each cylindrical cavity such as cylindrical cavity 21*a* extends through block 10 to meet cylindrical cavity 23 which extends through to the back surface 13 of block 10. Cavity 23 has a larger predetermined diameter of approximately 1.5 centimeters.

In the preferred embodiment, holes 21*a*–21*d* are vertically aligned and matched up with holes 12*a*–12*b*. Holes 21*a*–21*d* allow power bus bars to be secured to face 11 of block 10 through the use of bolts or other threaded members that extend through cavity 21*a* to cavity 23 and secured by a tightening member such as a nut. For example, bus bar 36 is vertically aligned over holes 21*d* (not shown completely) and hole 14*d* and secured in place by a bolt 31 which passes through an opening in bus bar 36 through cylindrical hole 21*d* and secured by a nut 9 within block 10.

In one embodiment bus bar 36 may include a built-in threaded member which extends through hole 21*d* to be secured by a tightening means such as nut 13. Holes 12*a*–12*d* and holes 21*a*–21*d* are alternated above and below each other to allow tighter horizontal spacing of the holes in block 10.

In one embodiment, the set of holes 12*a*–12*d* and 21*a*–21*d* may be repeated two or more times (not shown) further down face 11 of block 10. This provides three separate locations for securing power bus bars to face 11, of block 10, and allows three separate connections of power supplies to power bus bars, as will be seen in FIG. 5. Alignment members 14*a*–14*d* are also repeated further down face 11 of block 10 if the length of the bus bar warrants these additional members.

Block 10 may also include securing beams 29*a*–29*b*, for aligning and securing block 10 inside an electronic system using a securing means which passes through holes 27*a*–27*b*, such as bolts. Securing beams 29*a*–29*b* may be repeated further down on block 10 as required by the length of the block.

Bus bar alignment members 14*a*–14*d* such as pins, are provided in the bus bars below corresponding holes 12*a*–12*d* and 21*a*–21*d* for aligning the power bus bar in front of each hole 21*a*–21*d*. Alignment markers 14*a*–14*d* engage with corresponding holes in the power bus bars to hold them in place as it will be seen in FIG. 5. For example, bus bar 36 is aligned vertically on block 10 by alignment pin 14*d* and securing bolt 31. This aligns power bus bar 36 in front of hole 12*d* on face 11 of block 10.

Figure 2:
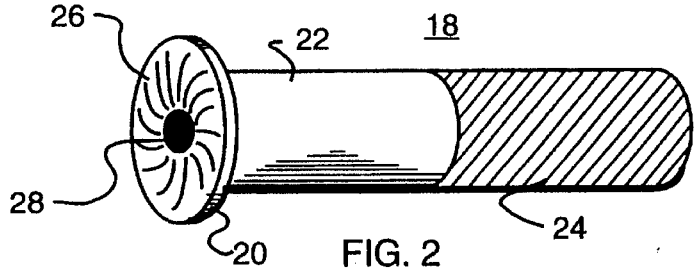
FIG. 2 is a side sectional view of the power coupling connector element of the power interconnect system of the present invention.
Figure 3:
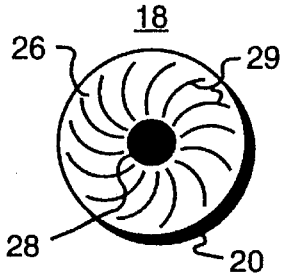
FIG. 3 is a front view of the power coupling connector element of FIG. 2.

The present invention also features a power coupling connector element 18, FIG. 2, including an electrically conductive section 22, and an electrically insulative section 24. Electrically conductive section 22 extends from a larger diameter section 20 having face 6. In the preferred embodiment, electrically conductive section 22 has a length of approximately 2.4 centimeters, and electrically insulative section 24 has a length of approximately 2.8 centimeters. Larger diameter section 20 typically has a diameter of 1.8 centimeters while the diameter of electrically conductive section 22 (not including larger diameter section 20) and insulative section 24 is approximately 1.3 centimeters. The face 26 of power coupling connector element 18 surrounds threaded opening 28. In the preferred embodiment, electrically conductive section 22 of power coupling connector element 18 is made from cold rolled steel for strength and electrical conductivity, while electrically insulative section 24 is made of Lexan® or other insulative polycarbonate type material. Other similar materials may be utilized within the scope of the invention. Face 26 may preferably include a knurled surface pattern 29, FIG. 3, which provides conductive face 26 with better contact with another mating electrically conductive surface such as a bus bar, as will be explained below.

Figure 4:
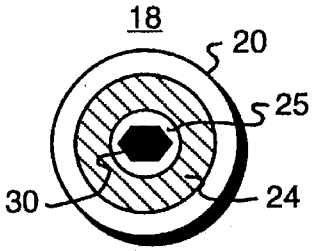
FIG. 4 is a back view of the power coupling connector element of FIG. 2.

FIG. 4 provides a back view of power coupling connector element 18. The electrically insulative section 24 provides a center cavity 25 which extends through the entire length of electrically insulative section 24 at least partially into electrically conductive section 22. The back of electrically conductive section 22 contains a recess 30 which allows for the insertion of a torque or other tightening tool. This allows torque to be applied so as to tighten the power coupling connector element when it is attached to a threaded member through threaded opening 28 on the front of power coupling connector element 18. Since tightening recess 30 is within the cold rolled steel electrically conductive section 22 of power coupling connector element 18, sufficient torque may be applied to securely tighten the power coupling connector to a threaded member. In the preferred embodiment tightening recess 30 comprises a hex socket although any shape performing the same function is contemplated by the present invention.

Figure 5:
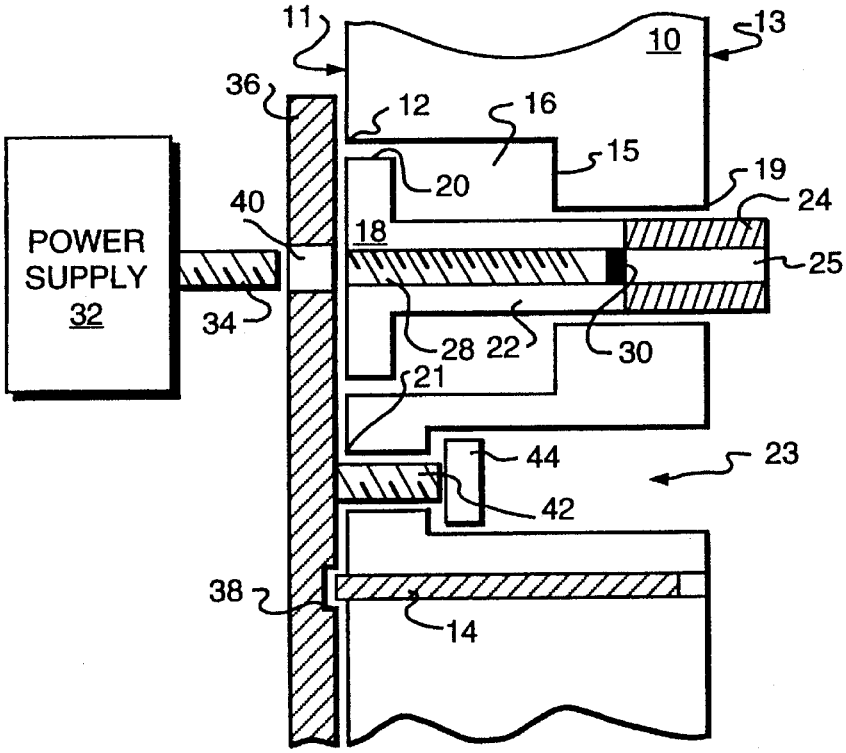
FIG. 5 is a sectional view of the power interconnect system of the present invention showing the power coupling connector element in place in the electrically insulative enclosure.

FIG. 5 shows the power interconnect system of the present invention in use. The power coupling connector element 18 comprising electrically conductive section 22 and electrically insulative section 24 is inserted into cavity 16 and insulative block 10. Electrically insulative section 24 extends through the rear opening 19 while the power coupling connector element 18 is held captive by larger diameter section 20 which is blocked by lip region 15 from passing through the back 13 of block 10. Therefore, power coupling connector element 18 cannot become separated from insulative block 10 through rear opening 19.

Power bus bar 36 comprising an electrically conductive material, typically copper, is placed in front of insulative block 10. Power bus bar 36 is held in alignment by one or more methods such as alignment pins 14 which engage with power bus bar 36 in cavity 38. Power bus bar 36 may also include one or more threaded members 42 which extend through hole 21 in block 10 to cavity 23. An attachment means with an internally threaded region 44, such as a nut, may be threaded onto threaded member 42 and tightened down to secure power bus bar 36 against the front 11 of block 10. Alignment pin 14 and threaded member 42 keep power bus bar 36 in vertical alignment on the front of block 10.

Sources of electrical power such as power supply 32 may include a power connection such as a threaded member 34 which is aligned to engage power bus bar 36 through hole 40. Threaded member 34 is made of an electrically conductive material, such as cold rolled steel which allows electrical power to flow from power supply 32 through any electrically conductive material in contact with threaded member 34. When a power supply 32 is inserted into the electrical assembly threaded member 34 is inserted through hole 40 of power bus bar 36 and engages with internal threaded region 28 of power coupling connector element 18.

Power coupling connector element 18 can then be screwed onto threaded member 34 first by hand using insulative section 24, of power supply 32 by grasping and finally tightened down against power bus bar 36 using a torque providing tool inserted in recess 30. This will provide an electrical path through threaded member 34 into electrically conductive section 22 of power coupling connector element 18, through face 26 which contacts power bus bar 36. The knurled surface of face 26 of power coupling connector element provides good electrical contact with power bus bar 36, and also helps prevent loosening once the power coupling connector element 18 is tightened onto threaded member 34.

Since no electrically conductive material extends through the back of block 10, there is no chance for a short to occur through any person or object, even if the power supply is on. This allows power supply to be removed from the electrical system even while other power supplies are present and the system is running, without danger to an individual servicing the system. A person can loosen power coupling connector element 18 using his or her fingers to unscrew power coupling connector element 18 by grasping electrically insulative section 24. Power supply 32 may then be removed from the system and replaced, wherein a servicing person can finger tighten power coupling connector element 18 onto threaded member 34 to help prevent cross threading.

Power coupling connector element 18 may then be tightened down using a tightening tool such as a torque wrench or screwdriver which inserts into recess 30 of power coupling connector element 18. Also, while power supply 32 is removed from the system, power coupling connector element 18 is held captive within block 10 by power bus bar 36 secured on face 11 of block 10 and lip region 15 which prevents power coupling connector element 18 from separating from block 10. Therefore, there is no chance of power coupling connector element 18 becoming loose and either becoming lost within the system or causing a short against other live power supplies or power bus bars.

Therefore, the present invention provides a high degree of simplicity and safety for changing and replacing power supplies within an electrical assembly. Even if the system is on and power bus bar 36 is hot from other power supplies, a person servicing the system cannot receive an electrical shock or short out the system while disconnecting power coupling connector element 18. Further, once power coupling connector element 18 is separated from threaded member 34, power coupling connector element 18 cannot become separated from insulative block 10. When a new power supply is inserted and threaded member is inserted through hole 40 in power bus bar 36, power coupling connector element 18 may be finger tightened onto threaded member 34 to prevent cross threading and reconnect the power supply to the system. Thus, power supply insertion and removal is greatly simplified and can even be performed on a running system with relative safety.

Modifications and substitutions by one of ordinary skill in the art are considered to be within the scope of the present invention which is not to be limited except by the claims which follow.

What is claimed is:

1. A power interconnect system for electronic assemblies comprising:

a source of electrical power including a threaded member protruding therefrom;

at least one power coupling connector element, coupled to said source of electrical power;

at least one remote electrical conductor element, electrically coupled to said source of electrical power by said at least one power coupling connector element, for conducting electrical power to a location remote from said source of electrical power; and an electrically insulative member, coupled to said at least one remote electrical conductor element, and in which is captively mounted said at least one power coupling connector element.

2. The power interconnect system of claim 1, wherein said power coupling connector element includes a threaded recess engageable with said threaded member.

3. The power interconnect system of claim 1, wherein said power coupling connector element includes a first end and a second end, said first end including a predetermined diameter larger than a predetermined diameter of said second end; and wherein said power coupling connector element is disposed inside a cylindrical cavity of said electrically insulative member, said cylindrical cavity having a first end with a first predetermined diameter and a second end with a second predetermined diameter, said second predetermined diameter of said second end of said cylindrical cavity being less than said first predetermined diameter of said first end of said cylindrical cavity, said predetermined diameter of said second cylindrical cavity also being less than said predetermined diameter of said first end of said power coupling connector element, whereby said power coupling connector element is prevented from separating from said electrically insulative member through said second cylindrical cavity by said second smaller predetermined diameter of said second end of said cylindrical cavity.

4. The power interconnect system of claim 1, wherein said at least one remote electrical conductor element includes a power bus bar.

5. The power interconnect system of claim 1, wherein said power coupling connector element further includes:

a threaded region internal to said power coupling connector element, extending from said first end towards said second end; and said first end including a conductive material and said second end including an electrically insulative material.

6. The power interconnect system of claim 5, wherein said first end includes a diameter larger than a diameter of said second end.

7. The power interconnect system of claim 5, wherein said first end includes a knurled face region.

8. The power interconnect system of claim 5, wherein said second end includes a recess for engaging with a means for applying a tightening force to said power coupling connector element.

9. The power interconnect system of claim 8, wherein said recess contained in said second end includes a hex socket and said means for applying a tightening force includes a hex wrench.

10. The power interconnect system of claim 1, wherein said conductive material included in said first end includes cold rolled steel.

11. The power interconnect system of claim 1, wherein said electrically insulative material said second end includes a Polycarbonate material.

12. A method of interconnecting a source of electric power to a remote electrical conductor element in an electronic assembly, comprising the steps of:

providing a source of electrical power including a threaded member;

providing a remote electrical conductor element;

providing at least one power coupling connector elements, said at least one power coupling connector element including a conductive first end and an insulative second end, said conductive first end including a diameter larger than said insulative second end, said at least one power coupling connector element also including a threaded region integral to said at least one power coupling connector element, and extending from said conductive first end towards said insulative second end;

providing an electrically insulative member including at least one cylindrical cavity into which has been inserted said at least one power coupling connector element;

positioning said remote electrical conductor element between said source of electrical power and said at least one power coupling cavity of said connector element disposed in said cylindrical electrically insulative member; and engaging said threaded member of said source of electrical power with said threaded region of said at least one power coupling connector element.

13. A power interconnect system for electronic assemblies comprising:

a source of electrical power;

at least one power coupling connector element, coupled to said source of electrical power;

at least one remote electrical conductor element including a power bus bar, electrically coupled to said source of electrical power by said at least one power coupling connector element, for conducting electrical power to a location remote from said source of electrical power; and an electrically insulative member, coupled to said at least one remote electrical conductor element, and in which is captively mounted said at least one power coupling connector element.

* * * * *